US008444078B1

(12) United States Patent
Brown et al.

(10) Patent No.: US 8,444,078 B1
(45) Date of Patent: May 21, 2013

(54) CABLE REEL

(75) Inventors: Larry C. Brown, Odon, IN (US); Phillip S. Mitchell, Springville, IN (US); Joseph Ringwald, Loogootee, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 293 days.

(21) Appl. No.: 12/926,448

(22) Filed: Nov. 18, 2010

Related U.S. Application Data

(63) Continuation-in-part of application No. 11/314,884, filed on Dec. 23, 2005, now abandoned.

(51) Int. Cl.
*B65H 75/40* (2006.01)

(52) U.S. Cl.
USPC ..... 242/403

(58) Field of Classification Search
USPC ..... 242/388, 395, 395.1, 398, 403, 403.1, 242/588, 557, 400, 406, 399, 388.1, 388.6; 248/346.01, 676, 80, 220.22, 220.21, 222.51, 248/289.11, 329; 384/428, 424, 295, 276, 384/275, 416–420
See application file for complete search history.

(56) References Cited

U.S. PATENT DOCUMENTS

| | | | | | |
|---|---|---|---|---|---|
| 294,843 | A * | 3/1884 | Belford | ..... | 242/403.1 |
| 3,976,260 | A * | 8/1976 | Irik | ..... | 242/403 |
| 4,706,906 | A * | 11/1987 | Roman et al. | ..... | 242/401 |
| 5,588,613 | A * | 12/1996 | Nagy | ..... | 242/395 |
| 5,775,621 | A * | 7/1998 | Sauber | ..... | 242/391.1 |
| 2004/0245362 | A1 * | 12/2004 | Ast et al. | ..... | 242/388.6 |

* cited by examiner

*Primary Examiner* — William E Dondero
(74) *Attorney, Agent, or Firm* — Christopher A. Monsey

(57) ABSTRACT

The invention involves a novel configuration for a cable reel and two discs. The discs are disposed on opposite sides of the spool and the two discs are able to spin independently from the spool.

27 Claims, 9 Drawing Sheets

CABLE REEL

This application is a continuation in part of application Ser. No. 11/314,884 filed Dec. 23, 2005 now abandoned.

STATEMENT OF GOVERNMENT INTEREST

The invention described herein may be manufactured and used by or for the Government of the United States of America for governmental purposes without payment of any royalties thereon or therefor.

BACKGROUND

The present invention relates to a cable reel. More specifically, but without limitation, the present invention relates to a cable reel suited for one hundred pound fiber optic cable.

Currently the United States military stores fifteen hundred meter, one hundred pound fiber optic cable on a reel that has a center made of four rods. The cable is wound around the four rods, which bends the cable at about 90 degrees, causing signal loss and permanent deformation to the cable. In order to deploy the cable, a rod must be placed in the center hub of the spool and held at each end by two people while a third person unrolls or rewinds the cable. This utilizes valuable manpower and time, especially in a military environment. Often the spool is rolled on the ground to deploy the fiber cable, which damages the fragile cable due to spool hub and rim diameter differential.

Thus, there is a need in the art to provide a spool without the limitations inherent in present methods.

SUMMARY

The present invention is directed to a cable reel including a spool and two discs. The discs are disposed on opposite sides of the spool, and the two discs are able to spin independently from the spool.

It is a feature of the invention to provide a cable reel that allows cable to be deployed by one person.

It is a feature of the invention to provide a cable reel that allows easier rewinding, specifically to allow rewinding with a hand crank while the reel is stationary or rolling on the ground, or in the back of a moving vehicle.

It is a feature of the invention to provide a cable reel that reduces failures, increases the capability of the cable by protecting its inherent qualities, increases mean time between failures, reduces the amount of manpower required to employ these cables and reduce set up time and tear down time.

It is a feature of the invention to provide a cable reel that allows easier deployment of a cable, specifically without stretching or dragging cable due to circumference differential of reel and cable as it reduces in diameter during deployment.

BRIEF DESCRIPTION OF THE DRAWINGS

These and other features, aspects and advantages of the present invention will become better understood with reference to the following description and appended claims, and accompanying drawings wherein:

DETAILED DESCRIPTION

Figure 1:
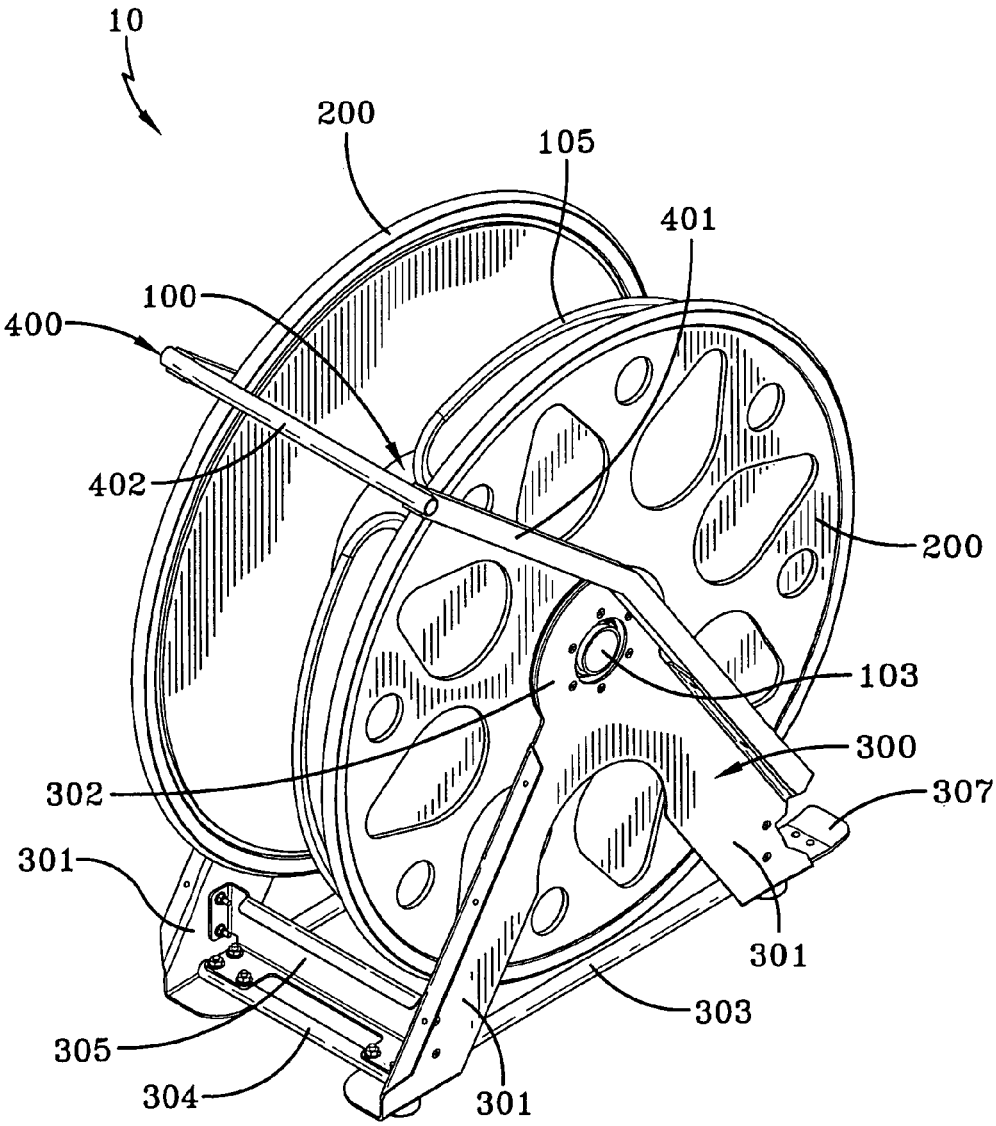
FIG. 1 is a perspective view of an embodiment of the cable reel.
Figure 3:
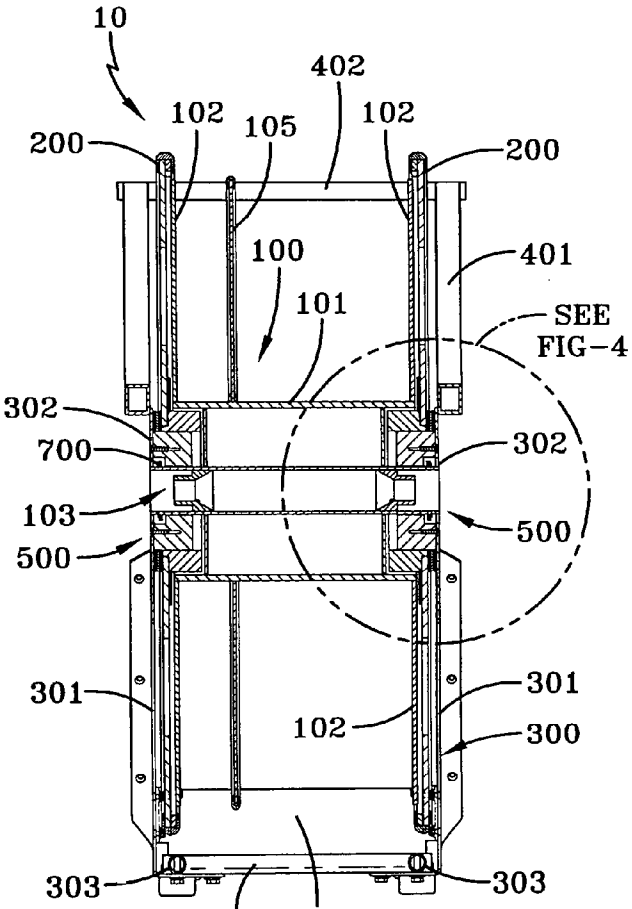
FIG. 3 is a side view taken through section 3-3 of FIG. 2.
Figure 2:
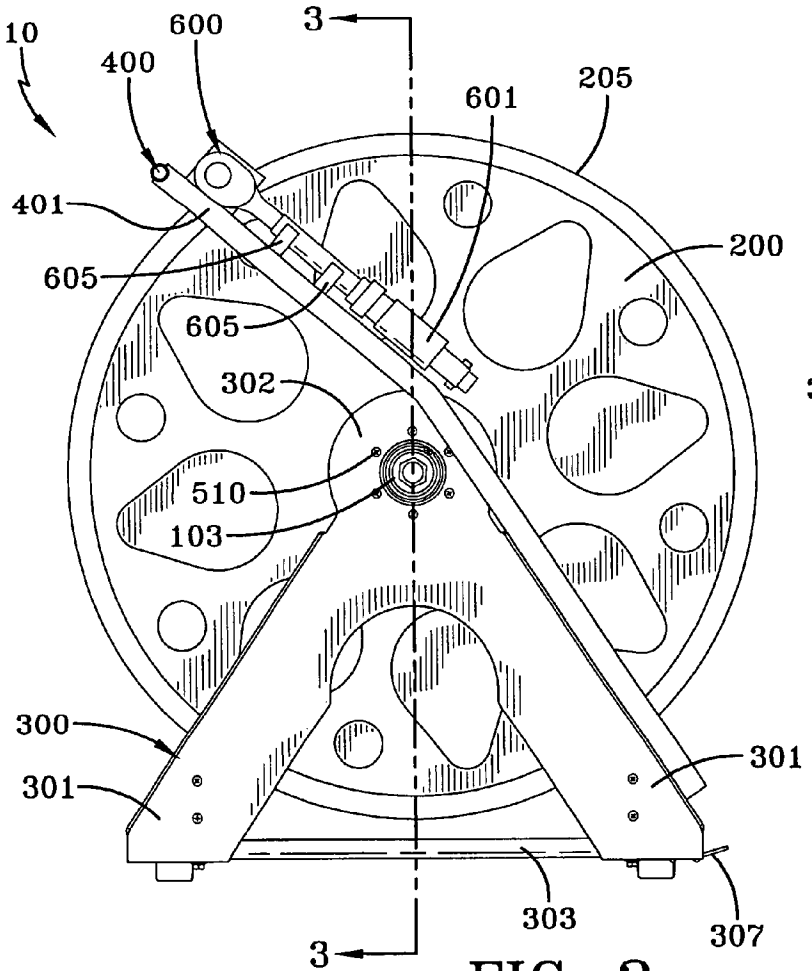
FIG. 2 is a side view of an embodiment of the cable reel.

The preferred embodiments of the present invention are illustrated by way of example below and in the above referenced figures. As seen in FIGS. 1, 2, and 3, the cable reel 10 includes a spool 100 and two discs 200. The two discs 200 may be disposed on opposite sides of the spool 100. The discs 200 are attached to the spool 100 such that the discs 200 are able to spin independently from the spool 100. The two discs 200 and the spool 100 may be axially aligned.

In the discussion of the present invention, the invention will be discussed in a fiber optic cable environment; however, this invention can be utilized for any type of need that requires use of a reel.

In the preferred embodiment, the spool 100 is a spool weldment or a one piece welded assembly. As seen in FIG. 3, the spool 100 includes a spool cylinder 101. The spool cylinder 101 may be axially aligned with the two discs 200 and the spool 100. The spool 100 also includes two spool discs 102 disposed at opposite axial ends of the spool cylinder 101. In operation, the cable wraps around the spool cylinder 101. Each spool disc 102 is juxtapositioned next to a corresponding disc 200 (or on opposite sides of the spool cylinder 101); however, the spool discs 102 rotate independently from the discs 200. The spool 100 and/or discs 200 may be manufactured from plastics, composites, aluminums, or any material deemed practicable.

In the preferred embodiment, the two discs 200 are manufactured from aluminum and include rubber edge trim 205 on the outer diameter of each of the discs 200. The cable reel 10 may include bearings or a bearing system 500 that allows the discs 200 to be able to spin independently from the spool 100. In the one of the embodiments of the invention, each disc 200 has a larger outer diameter than each spool disc 102 and each disc 200 extends past each spool disc 102. In the preferred embodiment, both discs 200 are substantially similar, and both spool discs 102 are substantially similar.

The cable reel 10 may also include a base 300 and a handle 400. The base 300 may be rotatably attached to the spool 100 and the two discs 200. The spool 100 may include an axle hub 103 that is disposed within the spool cylinder 101. The spool cylinder 101 and the axle hub 103 may be axially aligned.

The axle hub 103 may be a hollow tube with an inner diameter 103*a* and an outer diameter 103*b*. Each disc 200 and the spool 100 may include a center chamber passing through each respective center axis (each center chamber may create an inner diameter for each disc 200 and the spool 100). The axle hub 103 may be disposed within each of these center chambers. The axle hub 103 may hold the spool 100, the two discs 200 and the base 300 together. A retaining ring 700 installed onto axle hub 103 prevents the discs 200 from slipping off the axle hub 103.

The base 300 may include a plurality of legs 301 and an attachment portion 302. In the preferred embodiment, there are two attachment portions 302 that are each rotatably attached, via the axle hub 103, to the discs 200 and the spool 100. Each attachment portion 302 may be partially circular. As seen in FIG. 2, two legs 301 may extend from each attachment portion 302 to the ground in order to stabilize and hold the cable reel 10. In the preferred embodiment, there may be two attachment portions 302 disposed on opposite sides of the spool 100 and on the outside of each of the two discs 200. The base 300 may include four legs 301, two on each side, two extending from each attachment portion 302 and extending past the outside diameter of each disc 200. The two legs 301 disposed on the same side of the cable reel 10 (the two legs 301 juxtapositioned next to the same disc 200 and extending from the same attachment portion 302) may be attached to each other via a beam 303. At one of its ends, each beam 303 may also include a flange 307. Each flange 307 may extend past the beam 303 (as well as the corresponding leg 301) so that the flanges 307 may hook onto a platform, trailer or the like, and allow a user to flip the cable reel 10 onto the platform or trailer. The base 300 may also include a crossbar 304 that is attached to legs 301 disposed on opposite sides of the cable reel 10. There also may be a trave 305 that is attached to both those same legs only above the crossbar 304. In another embodiment of the invention, the crossbar 304 may be attached to each of the beams 303 at opposite ends of the crossbar 304. The base 300 may be manufactured from plastics, composites, aluminums, metal, or any material deemed practicable.

The handle 400 may be a substantially u-shaped bar which includes two side portions 401 and a trave portion 402. Each side portion 401 is attached to a leg 301 of the base 300 at a first end. The two side portions 401 are attached to the trave portion 402 at a second end. The trave portion 402 has two opposite ends at which it is attached to the two respective side portions 401. As seen in FIG. 1, each side portion 401 is disposed on opposite sides of the cable reel 10.

The cable reel 10 may also include a ratchet 600 or hand crank. The ratchet 600 may be a standard hand crank ratchet. The ratchet 600 may include a ratchet adapter 601 that allows the ratchet 600 to be used to rotate the spool 100 via the axle hub 103. The cable reel 10 may also include a ratchet storage system 605 for holding and securing the ratchet 600 to the cable reel 10. The ratchet storage system 605 may be clips or the like. The ratchet storage system 605 may be disposed on the handle 400, particularly on one of the side portions 401 of the handle 400.

Figure 4:
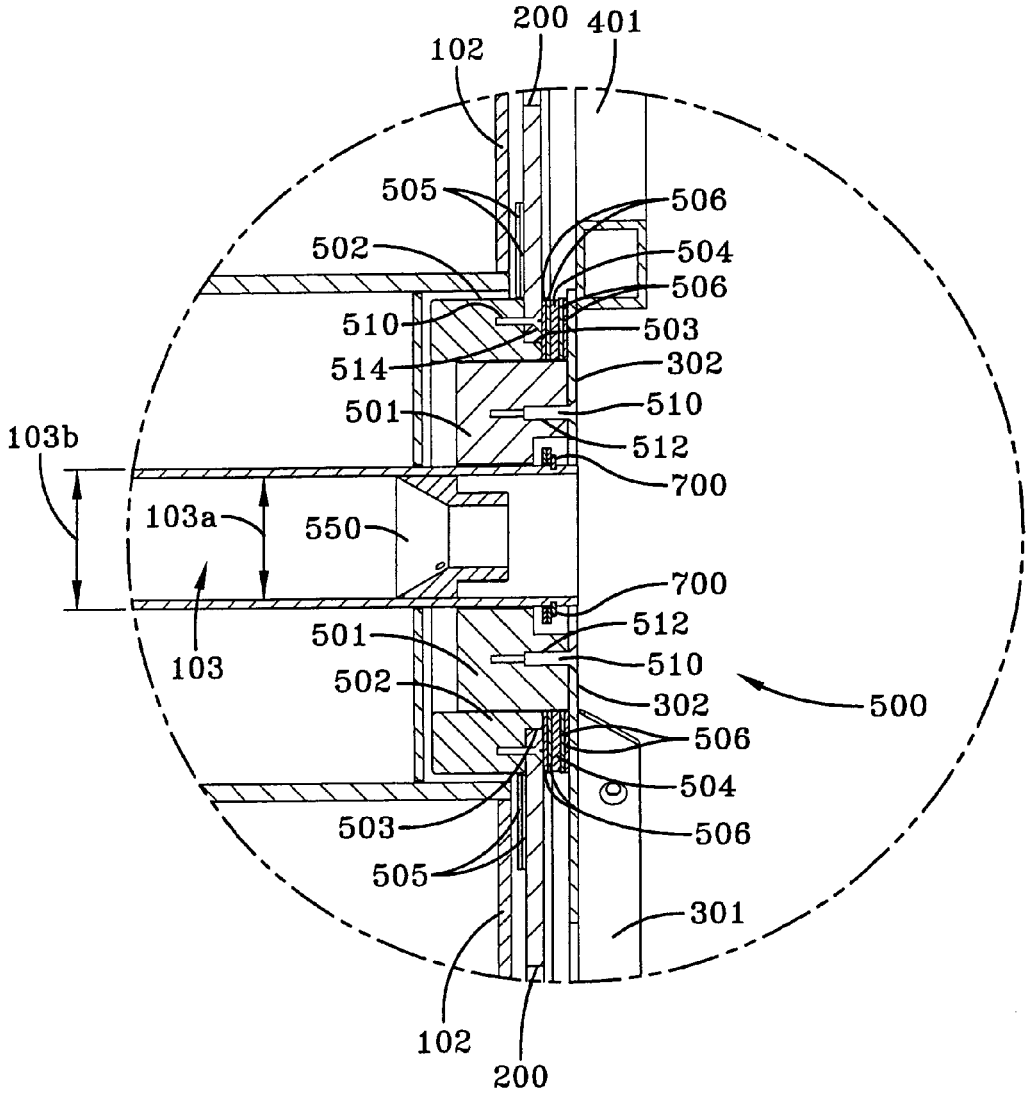
FIG. 4 is an enlargement of a section of FIG. 3.
Figure 5:
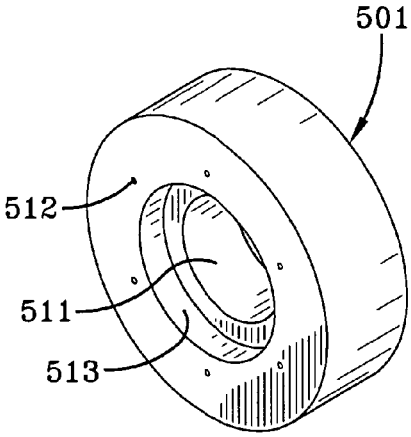
FIG. 5 is a perspective view of an embodiment of the bearing handle.
Figure 6:
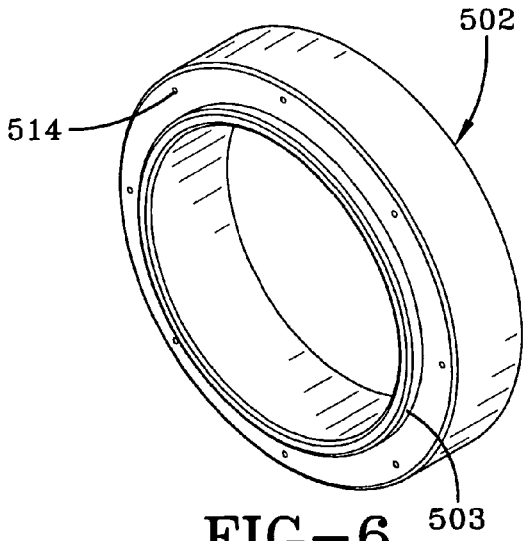
FIG. 6 is a perspective view of an embodiment of the bearing wheel.
Figure 7:
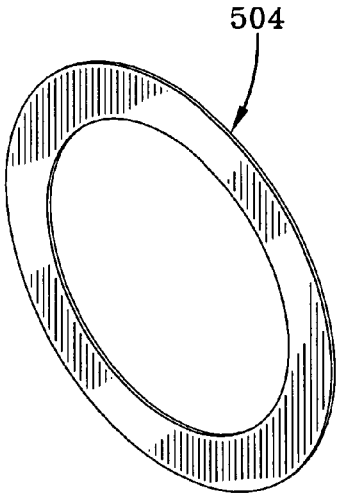
FIG. 7 is a perspective view of an embodiment of the handle spacer.
Figure 8:
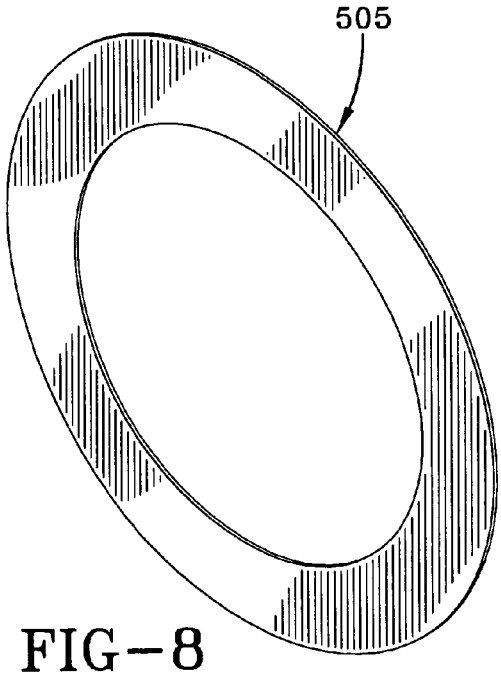
FIG. 8 is a perspective view of an embodiment of the reel spacer.

There may be two bearing systems 500 in the cable reel 10. Each disc 200 and spool disc 102 may have a corresponding bearing system 500 located on opposite sides of the cable reel 10. As shown in FIG. 4, the bearing system 500 may include a handle bearing 501 and a wheel bearing 502. The handle bearing 501, shown in FIG. 5, may be a donut shaped annulus that includes a handle bearing bore 511, fastener apertures 512 for accepting fasteners and a handle bearing counter bore 513. The handle bearing bore 511 and the handle bearing counter bore 513 may axially correspond. The handle bearing 501 may be manufactured from ultra thigh molecular weight polyethelene. The handle bearing 501 may be attached to the attachment portion 302 of the base 300. The handle bearing 501 and the attachment portion 302 may be attached or fastened in any manner practicable. As seen in FIGS. 2 and 4, the preferred fasteners are screws 510 screwed into the fastener apertures 512. As seen in FIG. 6, the wheel bearing 502 may be a donut shaped annulus with a fillet 503 at its inner diameter. As seen in FIG. 4, the wheel bearing 502 and the handle bearing 501 may be axially aligned and in rotational communication with each other, with the wheel bearing 502 enveloping the handle bearing 501. The wheel bearing 502 may also include wheel bearing fastener apertures 514. Wheel bearing fastener 514 in wheel bearing 502 attaches to the disc 200. As seen in FIG. 4, the inner diameter of the disc 200 may be in communication with the fillet 503, specifically fitting (and abutting) into the corner created by the fillet 503. The wheel bearing 502 may be attached to the disc 200. The preferred attachment or fastening method is screws via the wheel bearing fastener apertures 514. The wheel bearing 502 may be manufactured from ultra thigh molecular weight polyethylene. The bearing system 500 may also include a handle spacer 504 and a handle spacer bushing 506 and a reel spacer 505. The handle spacer 504, shown in FIGS. 4 and 7, may be ring like and may be disposed between the attachment portion 302 (specifically abutting against the fillet 503), the disc 200 and the wheel bearing 502. The handle spacer 504 and handle spacer bushing 506 may envelop the outer diameter of the handle bearing 501. The handle spacer 504 may be manufactured from vinyl foam. The reel spacer 505, shown in FIGS. 4 and 8, may be ring like and may be disposed between the spool disc 102 and the disc 200. As seen in FIG. 4, the reel spacer 505 may overlap or envelop the outer diameter of the wheel bearing 502. The reel spacer 505 may be manufactured from polytetrafluoroethylene or Teflon®.

Figure 9A:
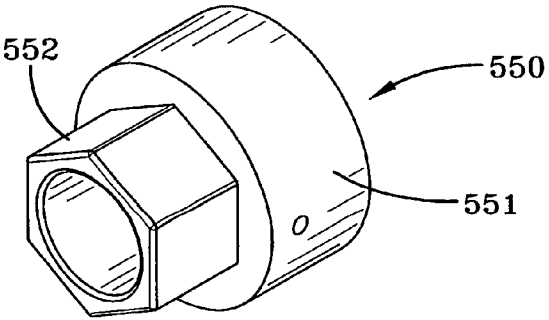
FIG. 9A is a perspective view of an embodiment of the hub ratchet adapter.
Figure 9C:
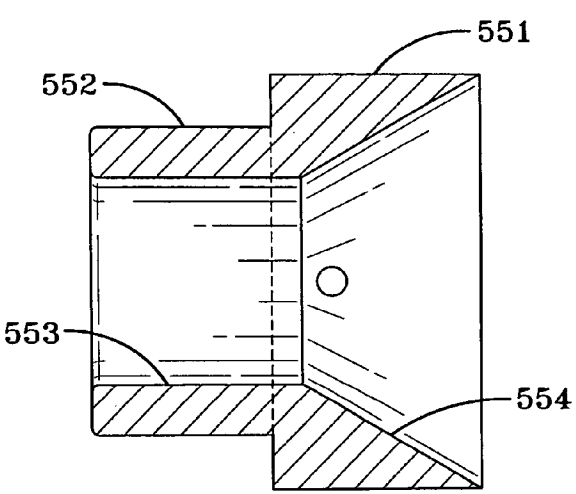
FIG. 9C is a cross-section taken through section 9C-9C of FIG. 9B.
Figure 9B:
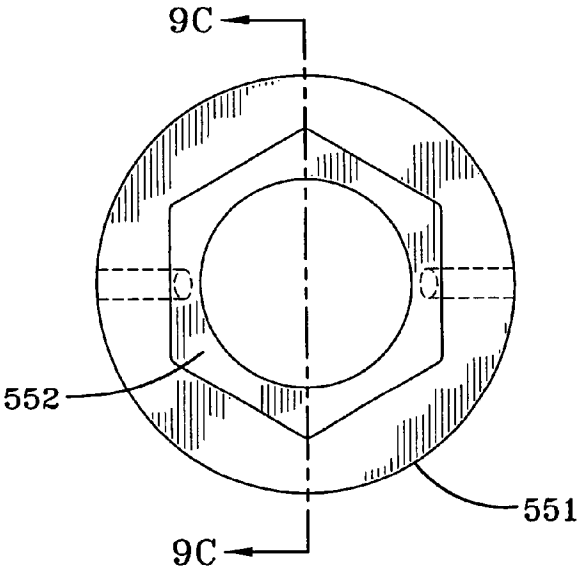
FIG. 9B is a top view of an embodiment of the hub ratchet adapter.

The cable reel 10 may also include a hub ratchet adapter 550. As seen in FIG. 4, the hub ratchet adapter 550 may be axially disposed within the axle hub 103, specifically within the inner diameter 103*a* of the axle hub 103. As seen in FIGS. 9A, 9B, and 9C, the hub ratchet adapter 550 may include a cylindrical portion 551 and a polygonal portion 552. The cylindrical portion 551 has a substantially circular cross section, while the polygonal portion 552 has a substantially polygonal cross section. The preferred embodiment of the polygonal portion 552 has a hexagonal cross section. The cylindrical portion 551 and the polygonal portion 552 may be axially aligned. The hub ratchet adapter 550 may include a bore 553 and a tapered bore 554. The bore 553 may extend through the polygonal portion 552 toward the cylindrical portion 551. At or about the cylindrical portion 551, or as shown in FIG. 9C just into the cylindrical portion 551, the bore 553 turns into the tapered bore 554 that tapers outward toward the outer diameter of the cylindrical portion 551.

The hub ratchet adapter 550 may correspond to the ratchet 600 (specifically the ratchet adapter 601) such that the ratchet 600 may to be used to rotate the spool 100 via the axle hub 103, allowing the user to unwind or rewind the cable.

In operation, the cable reel 10 may be tipped such that the two discs 200 are in contact with the ground and the base 300 is not in contact with the ground. Once the cable reel 10 is tipped and the two discs 200 are in contact with the ground, the discs 200 may be rolled to another location without the cable being dispensed because the spool 100 spins independently from the discs 200. To deploy the cable, the discs 200 may be rolled along the ground with the cable not secured. The axle hub 103 rotates on the inside diameter of the handle bearing 501, while the wheel bearing 502 inside diameter rotates on the handle bearing 501 outside diameter.

Figure 10:
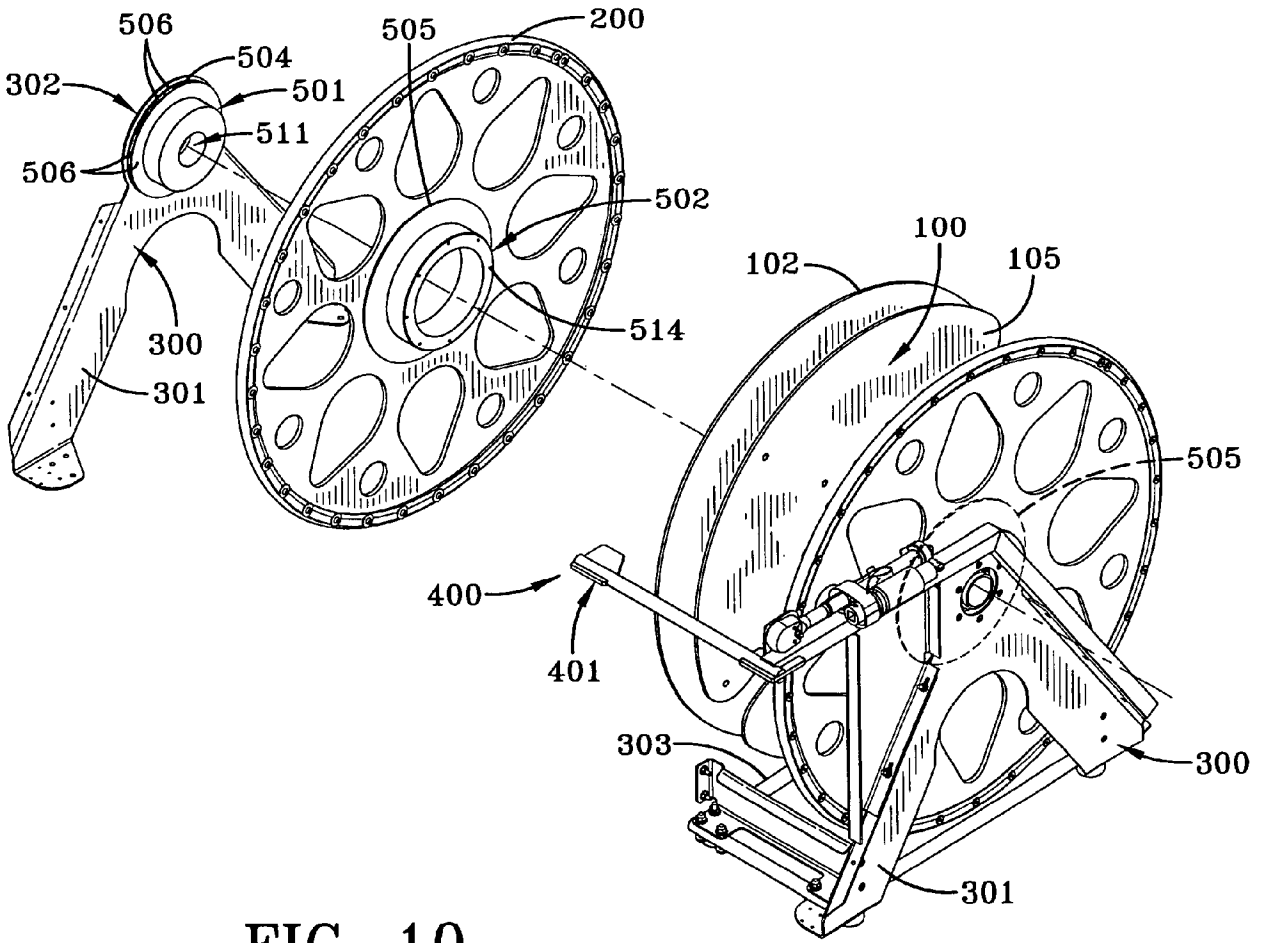
FIG. 10 is a perspective view of an embodiment of the cable reel in a partially exploded format from a first side.

Referring to FIG. 10, a cable reel embodiment is shown with one of disc 200 and base 300 comprising a bearing assembly pulled away from the cable reel assembly. In particular, base 300 includes legs 301 and attachment portion 302. Handle bearing 501 is coupled to attachment portion 302 with screws in this embodiment which pass through attachment portion 302. Two handle spacer bushings 506, one handle spacer 504, and two additional handle spacer bushings 506 are positioned on handle bearing 501 and in proximity to the attachment portion 302. The handle bearing 501 may be a donut shaped annulus that includes a handle bearing bore 511. Wheel bearing 502 is inserted into an aperture in the center of disc 200 and coupled with disc 200. Wheel bearing 502 has an inner circumference which permits insertion of the handle bearing 501 and relative rotation between the handle bearing 501 and wheel bearing 502. Reel spacers 505 are thin, flat, and circular shaped spacers which have an inner aperture having a diameter and circumference which permits them to be placed around a reel side of wheel bearing 502. FIG. 10 shows a center line showing the axis of rotation for the reel assembly which the bearings and discs rotate around when they are assembled together in proximity with spool disc 102. FIG. 10 also shows spool 100 and adjustable plate 105 coupled to the spool cylinder 101 (coupling not shown). Hidden lines show another set of installed reel spacers 505 in a non-exploded view on the opposing side of the spool 100 from the reel spacers 505 which is shown in exploded format. Base 300 is shown including legs 301 and a beam 303 which form, along with other components, a supporting assembly for the spool assembly. Handle 400 and u-shaped side portions 401 are also shown.

Figure 11:
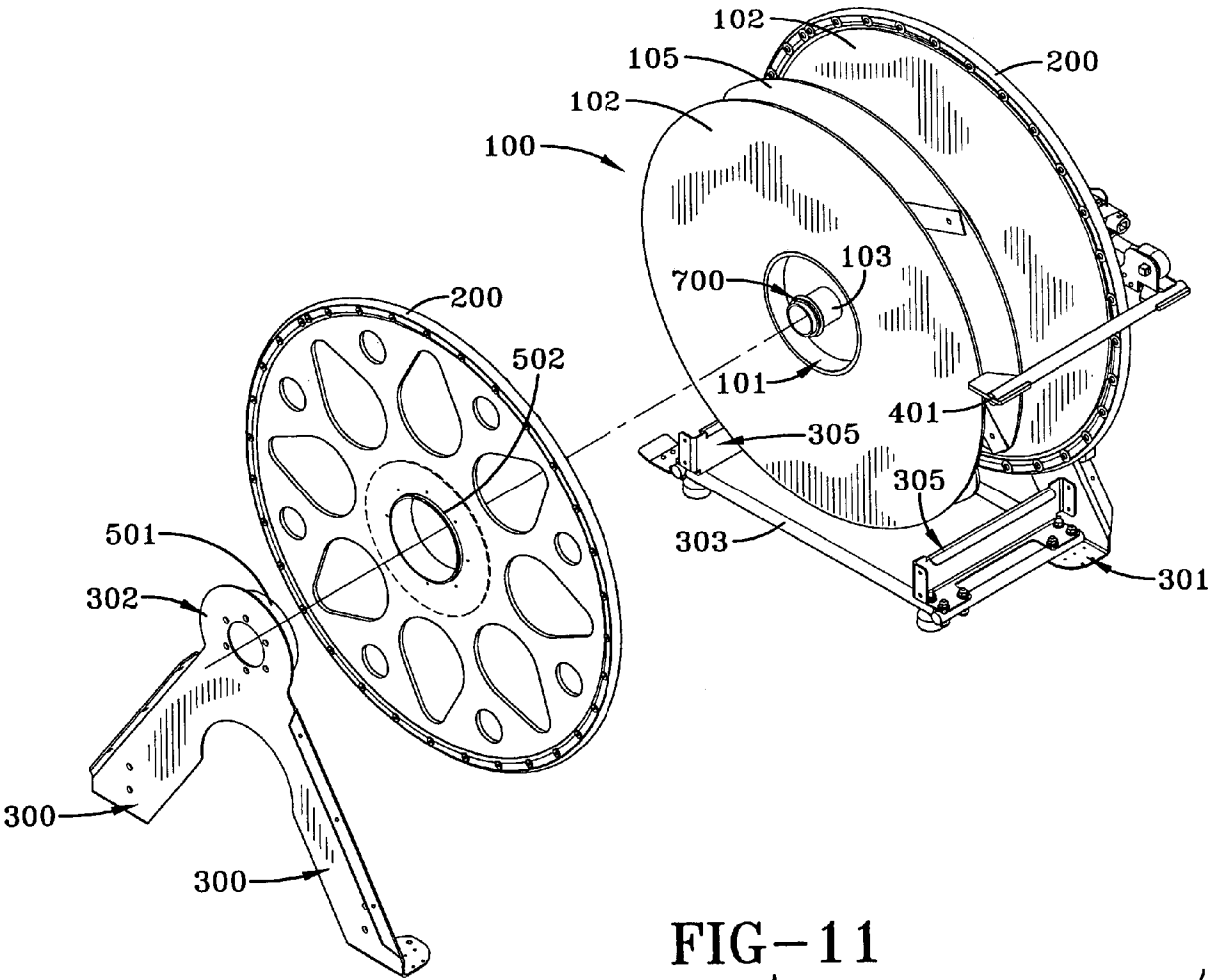
FIG. 11 is a perspective view of an embodiment of the cable reel in a partially exploded format from a second side.

FIG. 11 shows a perspective view from a reverse angle than shown in FIG. 10 where disc 200 and side assembly comprising a base 300 and attachment portion 302 are pulled away from the rest of the cable reel assembly along a line which runs through a rotational axis through the center of the cable reel. Handle bearing 501 is shown coupled to the attachment portion 302 of the side assembly using screws in this embodiment evenly spaced around the center of a hole which passes through the attachment portion 302. Disc 200 is shown with wheel bearing 502 coupled to disc 200 where portions of wheel bearing 502 on an opposing side of disc 200 are shown using hidden lines. Wheel bearing 502 is shown coupled to disc 200 using screws (in this embodiment) where the screws are evenly spaced around a circular path which is between an inner and outer edge of wheel bearing 502. A retaining ring 700 installed onto axle hub 103 prevents the discs 200 from slipping off the axle hub 103. As shown in FIG. 11, retaining ring 700 is actually installed onto the axle hub 103 even though disc 200 and attachment portion 302 are shown disassembled and in exploded format. The retaining ring is shown in the installed position to show where it would be located if the entire assembly was combined. Spool cylinder 101 is shown with a spool disc 102 installed on one end at an outer portion of the spool cylinder 101. Adjustable plate 105 is shown between the two spool discs 102 with another disc 200 in position next to the farther spool disc 102. Handle 400 and u-shaped side portions 401 are also shown attached to a side assembly (not shown) which is in turn coupled to a base assembly which includes legs 301, a trave 305, a beam 303.

Figure 12:
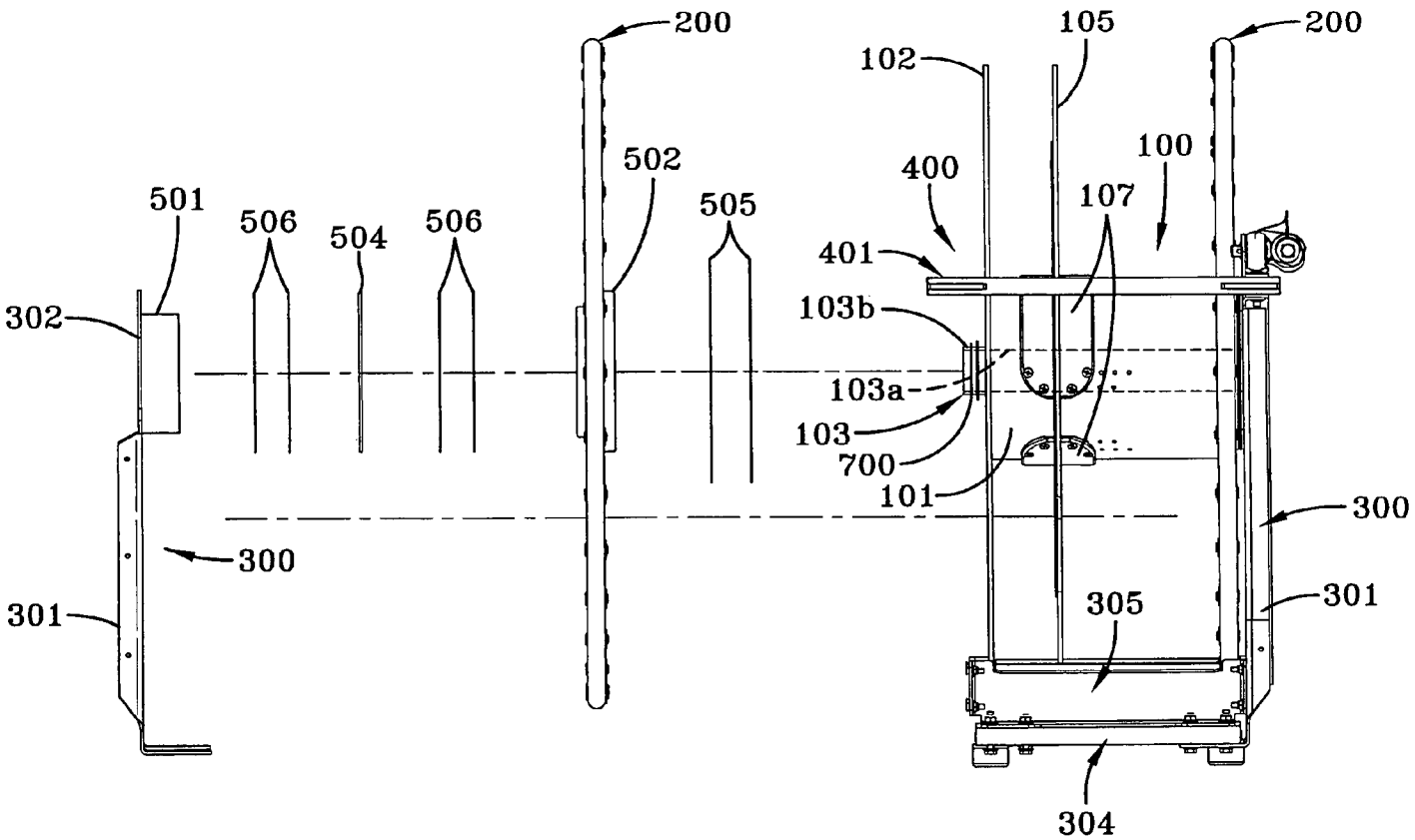
FIG. 12 is a side view of an embodiment of the cable reel in a partially exploded format.

FIG. 12 shows a side view that is parallel to the discs 200 where a bearing assembly (e.g., 501, 506, 504, 506, 502, 505), a side assembly (e.g., 301, 300, 302), disc 200 are shown pulled away from the rest of the cable reel 10 assembly. Side assembly including legs 301, base 300, and handle bearing 501 are shown coupled together with handle bearing attached to attachment portion 302. Two handle spacer bushings 506, one handle spacer 504, and two additional handle spacer bushings 506 are positioned on handle bearing 501 and in proximity to the attachment portion 302. Wheel bearing 502 is inserted into an aperture in the center of disc 200 and coupled with disc 200. Wheel bearing 502 has an inner circumference which permits insertion of the handle bearing 501 and relative rotation between the handle bearing 501 and wheel bearing 502. Reel spacers 505 are thin, flat, and circular shaped spacers which have an inner aperture having a diameter and circumference which permits them to be placed around a reel side of wheel bearing 502. FIG. 12 shows a center line showing the axis of rotation for the reel assembly which the bearings and discs rotate around when they are assembled together in proximity with spool disc 102. A retaining ring 700 installed onto axle hub 103 prevents the discs 200 from slipping off the axle hub 103. As shown in FIG. 12, retaining ring 700 is actually installed onto the axle hub 103 even though disc 200 and attachment portion 302 are shown disassembled and in exploded format. The retaining ring is shown in the installed position to show where it would be located if the entire assembly was combined. Handle bearing 501 is inserted onto axle hub 103 which may be a hollow tube with an inner diameter 103*a* and an outer diameter 103*b*. the spool 100 includes a spool cylinder 101. The spool cylinder 101 may be axially aligned with the two discs 200 and the spool 100. The spool 100 also includes two spool discs 102 disposed at opposite axial ends of the spool cylinder 101. The cable reel 10 also includes a base 300 and a handle 400. The base 300 is rotatably attached to the spool 100 and the two discs 200. Mounting hardware 107 is used to couple the adjustable plate 105 to the spool cylinder 101.

Figure 13:
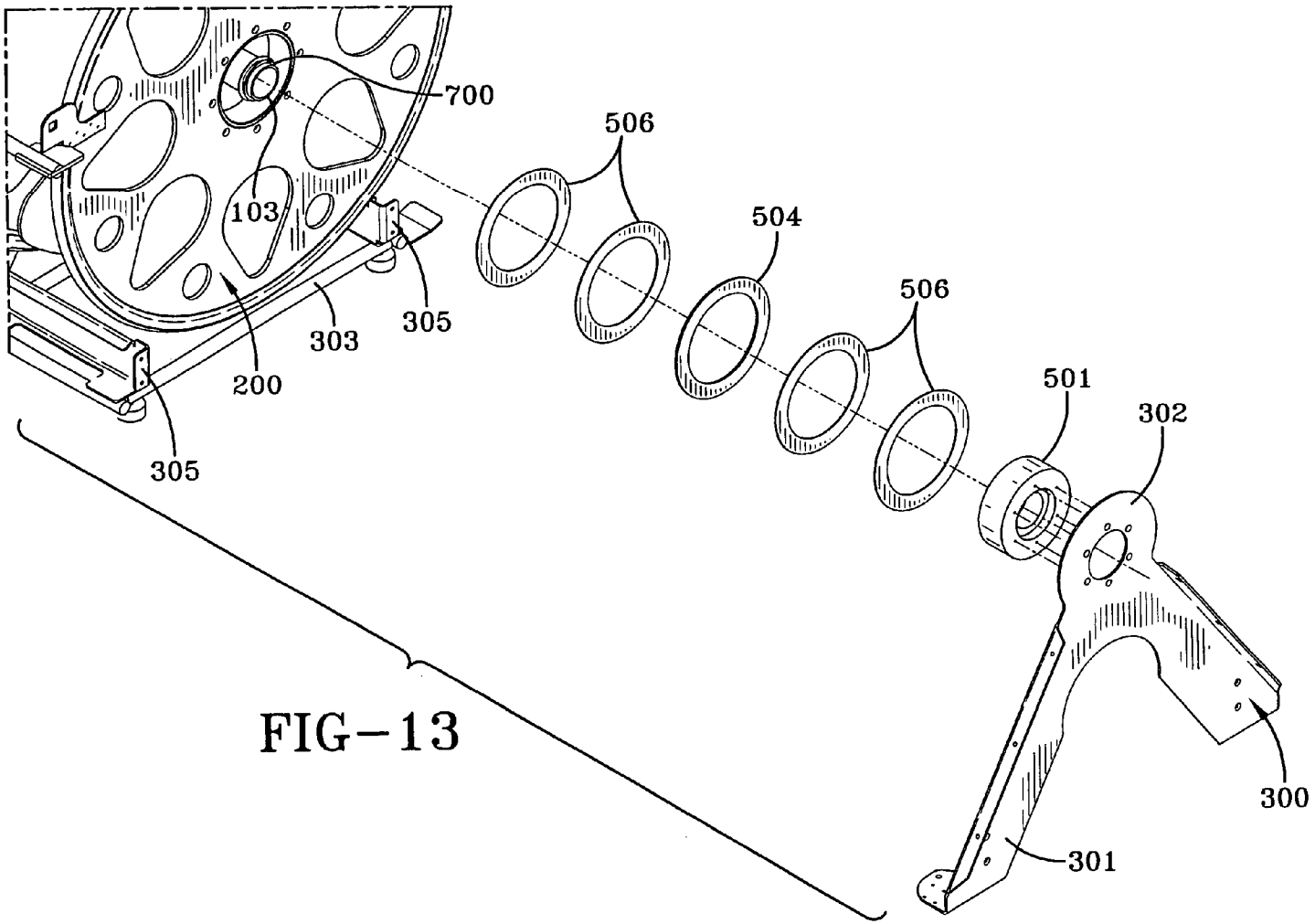
FIG. 13 is a perspective view of an embodiment of the cable reel with an embodiment of a bearing assembly shown in an exploded format.

FIG. 13 shows an exploded perspective view of the cable reel 10 with a side assembly (300, 301, 302) and a portion of the bearing assembly (501, 506 (2 each), 504 and 506 (2 each) pulled away from the cable reel 10 assembly. Sections of the base assembly are also shown (305, 303, 305). FIG. 13 also shows disc 200 in an installed position with retaining ring 700 in an installed position on axle hub 103 where it would be if the entire assembly was coupled together.

When introducing elements of the present invention or the preferred embodiment(s) thereof, the articles "a," "an," "the," and "said" are intended to mean there are one or more of the elements. The terms "comprising," "including," and "having" are intended to be inclusive and mean that there may be additional elements other than the listed elements.

Although the present invention has been described in considerable detail with reference to certain preferred versions thereof, other versions are possible. Therefore, the spirit and scope of the appended claims should not be limited to the description of the preferred versions contained herein.

What is claimed is:

1. A cable reel, comprising:

a spool;

two discs disposed on opposite sides of the spool, each disc axially and rotatably attached to the spool such that the discs are able to spin independently from the spool, a frame structure having a first and second frame member each respectively and rotatably coupled to said two discs and opposite sides of said spool, said frame structure further comprising a base portion coupled to said first and second frame members, said base portion comprising one or a plurality of flanges adapted to leveraging engage one end of said frame structure with another structure having one or more receiving structures by positioning said frame such that said one or plurality of flanges leveragingly engaging said receiving structure and applying an upward and radial force on one end of said frame such that said frame rotates around a rotation point defined by said one or plurality of flanges into a second position on said another structure.

2. The cable reel of claim 1, wherein the spool further includes a handle, the handle attached to the frame.

3. The cable reel of claim 2, wherein the handle is a substantially u-shaped bar surrounding the discs and spool, the handle includes two side portions and a trave portion, each side portion may include a first end and a second end, the first end of each side portion is attached to one of the legs, the second end of each of the side portion attached to the trave portion on opposite ends of the trave portion.

4. The cable reel of claim 3, wherein the cable reel includes a ratchet, the ratchet adapted such that the ratchet is able to rotate the spool via an axle hub coupled to said spool.

5. The cable reel of claim 4, wherein cable reel further includes a first and second bearing system, each of said first and second bearing system adapted to allow two discs to spin independently from the spool, said first and second bearing system each comprising a first, second and third bearing structures.

6. The cable reel of claim 4, wherein the spool includes a spool cylinder and two spool discs, the two spool discs disposed on axial opposite ends of the spool cylinder, each disc juxtapositioned next to each of a corresponding one of said two discs.

7. The cable reel of claim 6, wherein the cable reel further includes two bearing systems, each corresponding disc and spool disc having a corresponding bearing system.

8. The cable reel of claim 7, wherein each bearing system includes a handle bearing and a wheel bearing, the wheel bearing attached to the corresponding attachment portion, the handle bearing attached to the corresponding disc, the wheel bearing and handle bearing in rotational communication with the wheel bearing enveloping handle bearing.

9. A reel comprising:

a spool;

a first and second disc disposed on opposite side areas of said spool;

a third and fourth disc positioned on opposite sides of said spool, said third disc is positioned on one side of said first disc and said fourth disc is positioned on one side of said second disc;

a longitudinal member disposed within said spool, one portion of said longitudinal member is coupled to a portion of either said spool or said first disc;

a first and second rotational structure, said first and second rotational structure disposed on opposite sides of said spool; and a frame structure with a first and second member positioned on opposite sides of said spool;

wherein said first rotational structure comprises a first, second and third bearing structure adapted to rotate relative to each other;

wherein said first bearing structure is rotatably coupled to an end area of said longitudinal member and rotatably coupled to said second bearing structure;

wherein said second bearing structure is coupled to said first member and rotatably coupled to said third bearing structure;

wherein said third bearing structure is coupled to said third disc.

10. A reel as in claim 9, wherein said second rotational structure comprises:

a fourth, fifth and sixth bearing structure adapted to rotate relative to each other;

wherein said fourth bearing structure is rotatably coupled to a different end area of said longitudinal member and rotatably coupled to said fifth bearing structure;

wherein said fifth bearing structure is coupled to said second member and rotatably coupled to said sixth bearing structure;

wherein said sixth bearing structure is coupled to said fourth disc.

11. A reel as in claim 10, further comprising a seventh bearing structure disposed between said first member and said third disc and is adapted to reduce friction between said first member and said third disc.

12. A reel as in claim 11, further comprising an eighth bearing structure disposed between said second member and said fourth disc and is adapted to reduce friction between said second member and said fourth disc.

13. A reel as in claim 12, further comprising a ninth bearing structure disposed between the first disc and the third disc adapted to reduce friction between said first disc and said third disc.

14. A reel as in claim 13, further comprising a tenth bearing structure disposed between the second disc and the fourth disc adapted to reduce friction between said second disc and said fourth disc.

15. A reel as in claim 14, further comprising a retaining member adapted to hold the said second rotational structure with relation to said longitudinal member.

16. A reel as in claim 9, further comprising a fifth disc coupled to said spool between said first and second discs.

17. A reel as in claim 9, further comprising a flexible material removably coupled to an outer area of said third and fourth discs that is adapted to increase friction between an outer circumferal edge of said third and fourth discs and a surface that said third and fourth discs are placed in rolling contact with.

18. A reel as in claim 9, further comprising one or more protrusions coupled to one end portion of said frame adapted for removably coupling with another structure by inserting said one or more protrusions into said another structure and applying an upward and radial force to said frame.

19. A reel as in claim 9, further comprising a handle coupled to said frame adapted to permit manual handling and movement of said reel.

20. A reel as in claim 9, further comprising a crank receiver structure coupled to said longitudinal member that is adapted to receive a handle crank or another structure for applying rotational force to said longitudinal member and thereby rotate said spool.

21. A reel as in claim 9, further comprising a retaining member adapted to hold the said first rotational structure with relation to said longitudinal member.

22. A reel comprising:

a spool;

a first and second disc disposed in proximity to opposing side areas of said spool;

a third and fourth disc positioned in proximity to said opposing sides of said spool, said third disc is positioned on one side of said first disc and said fourth disc is positioned on one side of said second disc wherein said first and second discs have a smaller diameter than said third and fourth discs, said third and fourth discs are in closer proximity to an edge area of said opposing sides of said spool than said first and second discs;

a first and second edging structure respectively formed around an outer diameter edge of said third and fourth disc, wherein said first and second discs are each positioned to respectively rotate underneath a section of said first and second edging structure;

a longitudinal member disposed within and coupled to said spool at a center axis of rotation of said spool;

a first and second rotational structure assembly, said first and second rotational structure disposed and coupled to opposite sides of said spool; and a frame structure with a first and second member positioned on opposite sides of said spool;

wherein said first rotational structure assembly comprises a first and second bearing structure adapted to rotate relative to each other, wherein said first bearing structure has an outer section that couples with said first member and an inner section that rotatably couples to an end area of said longitudinal member which passes through an opening in said first bearing structure, said first bearing rotatably couples within said second bearing structure;

wherein said second bearing structure is coupled to said first member and rotatably coupled to said third bearing structure;

wherein said second bearing structure is coupled to said third disc.

23. A reel as in claim 22, further comprising a plurality of thrust bearing/spacers adapted to reduce friction, wherein at least one of said thrust bearing/spacers are positioned between said first member, third disc, first disc as well as between said second member, fourth disc, and second disc.

24. A reel as in claim 23, further comprising a flexible and compressible spacer positioned between two of said thrust bearings and positioned and rotates on said first bearing, wherein said flexible and compressible spacer is operable to reduce gaps between said bearings and discs.

25. A reel as in claim 22, further comprising a handle coupled to said frame adapted to permit manual handling and movement of said reel.

26. A reel as in claim 22, further comprising a crank receiver structure coupled to said longitudinal member that is adapted to receive a handle crank or another structure for applying rotational force to said longitudinal member and thereby rotate said spool.

27. A reel as in claim 22, further comprising one or more protrusions coupled to one end portion of said frame adapted for removably coupling with another structure by leveraging said one or more protrusions with a section of said another structure and applying an upward and radial force to said frame.

* * * * *